US005806129A

United States Patent [19]

Nelson

[11] Patent Number: 5,806,129

[45] Date of Patent: Sep. 15, 1998

[54] PAINT ROLLER ASSEMBLY WITH LOCK EQUIPPED END MEMBER

[76] Inventor: James A. Nelson, 251 Church Tree Rd., Crescent City, Calif. 95531

[21] Appl. No.: 714,015

[22] Filed: Sep. 11, 1996

Related U.S. Application Data

[63] Continuation of Ser. No. 511,106, Aug. 4, 1995, Pat. No. 5,594,971.

[51] Int. Cl.[6] ..... B05C 17/02

[52] U.S. Cl. ..... 15/230.11; 15/230.14

[58] Field of Search ..... 15/230.11, 230.14, 15/230.19, DIG. 10; D4/122; 401/197, 208

[56] References Cited

U.S. PATENT DOCUMENTS

| | | | |
|---|---|---|---|
| D. 341,265 | 11/1993 | Brazis et al. | D4/122 |
| 2,766,473 | 10/1956 | Thackara . | |
| 2,987,746 | 6/1961 | Davis et al. | 15/230.11 |
| 3,119,137 | 1/1964 | Schueler | 15/230.11 |
| 3,201,815 | 8/1965 | Selby | 15/230.11 |
| 3,225,373 | 12/1965 | Kisbany | 15/230.11 |
| 4,316,301 | 2/1982 | Smith et al. | 15/230.11 |
| 4,361,923 | 12/1982 | McKay . | |
| 4,422,201 | 12/1983 | Mckay | 15/230.11 |
| 4,557,011 | 12/1985 | Sartori | 15/230.11 |
| 4,897,893 | 2/1990 | Barker | 15/230.11 |
| 4,985,959 | 1/1991 | Lieberman et al. | 15/230.11 |

FOREIGN PATENT DOCUMENTS

| | | | |
|---|---|---|---|
| 0619159 | 4/1961 | Canada | 15/230.11 |
| 0922693 | 1/1955 | Germany | 15/230.11 |
| 0691265 | 5/1953 | United Kingdom | 15/230.11 |
| 0745750 | 2/1956 | United Kingdom | 15/230.11 |
| 2155147 | 9/1985 | United Kingdom | 15/230.11 |

*Primary Examiner*—Denise L. Ferensic
*Assistant Examiner*—James F. Hook
*Attorney, Agent, or Firm*—Hancock, Meininger & Porter, LLP

[57] ABSTRACT

A paint roller assembly includes a wire frame having a spindle on which a wire cage is rotatably mounted with end mounting bearing members. An outermost bearing member includes an annular wall provided with a flexible arm having a stop at its distal end. The stop normally abuts an end of a tubular paint roller to lock same against lengthwise movement. A paint barrier on the bearing member defines an area for momentary reception of the arm and stop during roller removal and installation procedures.

23 Claims, 1 Drawing Sheet

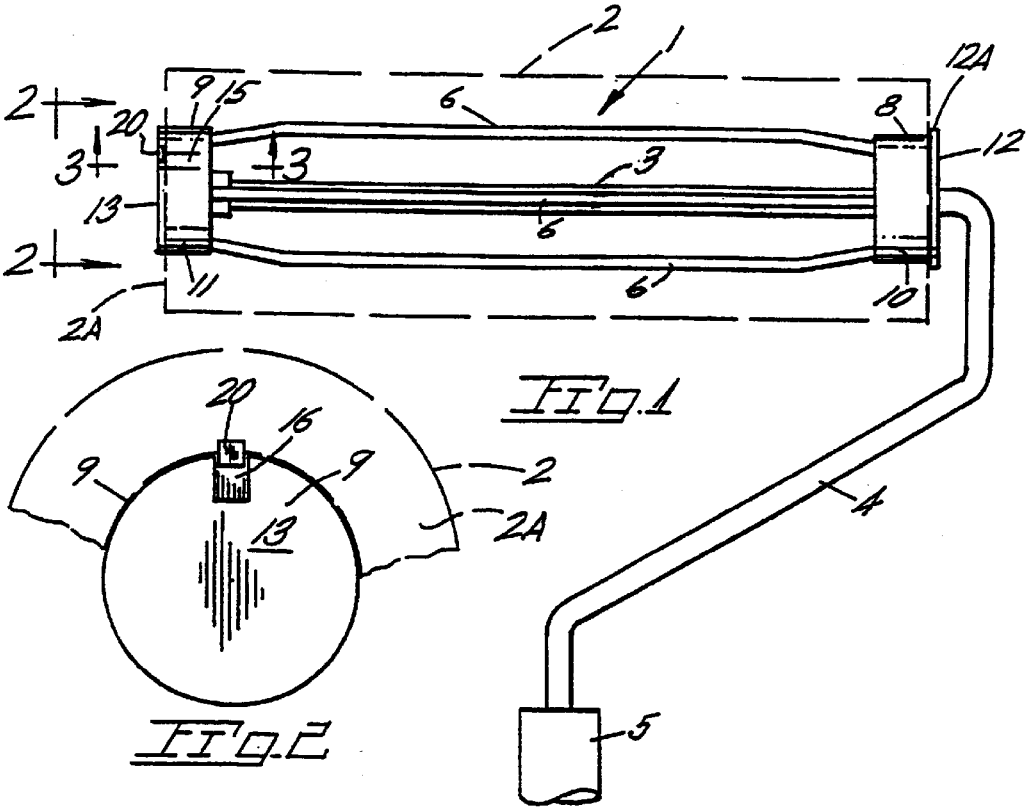
FIG. 1
FIG. 2
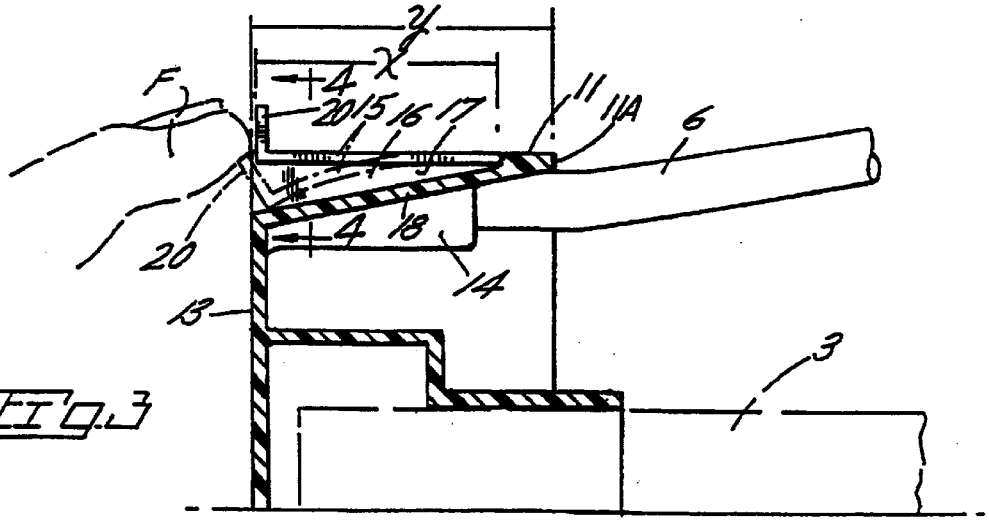
FIG. 3
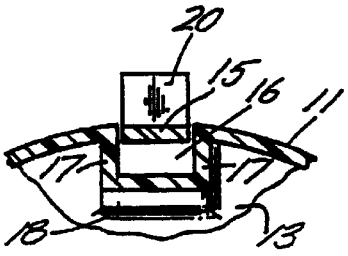
FIG. 4

PAINT ROLLER ASSEMBLY WITH LOCK EQUIPPED END MEMBER

This application is a continuation of U.S. patent application Ser. No. 08/511,106, filed Aug. 4, 1995 now U.S. Pat. No. 5,594,971.

BACKGROUND OF THE INVENTION

1. Field of the Invention

The present invention concerns a paint roller assembly of the type having a frame on which a tubular, paint carrying roller, is carried.

2. Description of the Related Art

In common use are roller frame assemblies on which paint laden rollers are rotatably carried for the painting of wall surfaces. The rollers are of a sleeve or tubular configuration for lengthwise installation on rotatable structure of the assembly. Paint rollers may rely on frictional engagement with a wire cage structure for retention. The wire members terminate in securement within sockets formed in circular end caps spaced along a spindle of the roller frame assembly.

Such roller frame assemblies are subject to failing to provide adequate frictional engagement with the inner wall of a paint roller with the result being gradual lengthwise displacement of the roller during use which necessitates stopping of a painting effort and repositioning of the roller back into place on the wire cage or other rotatable support. Such efforts contribute to an untidy painting operation and adds to the painting task at hand. A contributory factor is the failure of paint rollers to be a precise uniform inner diameter for snug engagement with the wire cap or other supporting structure. Long use of a roller can also cause loss of a snug fit with the roller frame assembly.

U.S. Pat. No. 4,316,301 discloses removable end cap structure at 22 and 122 which is complex design and assembly with closures 32 and 132. An inner end cap at 120 has an annular array of ridges 144 each on a wall segment 140*a* to accept a roll end. U.S. Pat. No. 4,422,201 discloses a lint removing tool wherein a sleeve supporting cylinder 32 terminates in an annular row of resilient fingers 40 in place entirely about the cylinder end. U.S. Pat. No. 4,361,923 shows a lint removing tool having an end cap 48 with a continuous series of flexible fingers. U.S. Pat. No. 3,201,815 shows a lint removal tool wherein a pair of flexible arms are each provided with a flange for retention of a tubular core of a tape roll.

SUMMARY OF THE PRESENT INVENTION

The present invention is embodied in bearing member of a roller frame assembly of the type receiving a tubular paint roller.

The bearing member includes an annular wall about which one end of a paint roller is supported. The present bearing member carries a lock which normally confines the roller against outward movement relative a spindle of the roller frame assembly. The lock is integral with the annular wall of the bearing member and includes an arm which may be radially displaced to momentarily displace a stop on the arm away from the roller end to permit extraction of the roller for replacement purposes. Similarly, the arm may be displaced by fingertip exerted pressure to position the stop radially inward to permit passage of the advancing end of a replacement roller. The bearing member also constitutes a barrier to preventing the entry of paint into the interior of the roller.

Important objectives of the present invention include the provision of a positive, manually operated lock to confine a paint roller against undesired longitudinal movement when in use on a roller frame assembly; the provision of an outer bearing member of a roller frame assembly with a lock including a flexible arm having a radially directed stop normally disposed in abutment with an end of a paint roller and is displaceable by fingertip pressure for purposes of roller removal and replacement; the provision of a bearing member on a roller frame which includes a stop positionable by fingertip pressure to confine a paint roller against lengthwise movement yet permitting rapid roller removal and installation of a replacement roller without the use of a tool.

BRIEF DESCRIPTION OF THE DRAWINGS

In the accompanying drawings:

FIG. 1 is an elevational view of a roller frame assembly with a paint roller thereon shown in phantom lines;

FIG. 2 is an end view of FIG. 1 taken along line 2—2 thereof;

FIG. 3 is a sectional view taken along line 3—3 of FIG. 1;

FIG. 4 is a vertical sectional view taken along lines 4—4 of FIG. 3.

DETAILED DESCRIPTION OF THE PREFERRED EMBODIMENTS

With continuing reference to the drawings, the reference numeral 1 indicates generally rotatable structure for the reception of a roller 2 for rotatably mounting the roller on a spindle 3. Spindle 3 is an extension of a bent wire frame 4 which terminates in a handle 5. The rotatable structure above noted may include what is referred to in the trade as a wire cage for those roller frame assemblies utilizing multiple wires as at 6 on which tubular roller 2 is slidably mounted. The wire ends are received in later described sockets disposed interiorly about inner and outer bearing members 8 and 9 each having an annular wall 10 and 11. Additionally the bearing members include end walls at 12 and 13. End wall 12 has a rim 12A.

The foregoing is intended to be a description of a typical roller frame assembly. However, it is to be understood that such an assembly may dispense with the wire members and rely solely on bearing members 8–9 for support of a tubular roller. Sockets 14 receive ends of wire 6.

With further attention to outer bearing member 9, the same is modified to include the present invention and provides a lock to retain roller 2 against axial displacement during painting. An arm 15 is integral at its proximal end with a bearing member annular side wall 11. A channel 16 in the bearing member is defined by sidewalls 17 (FIG. 4) and an interconnecting wall 18. Such a wall arrangement is of U-shape in transverse section to define area 16 which receives arm 15 during momentary displacement by a fingertip F. The walls 17–18 provide a barrier which prevents the flow of paint into the interior of the bearing member. Arm 15 is of a length indicated at X which constitutes a major portion of the axial dimension indicated at Y of the bearing member.

With attention again to arm 15, the same terminates at its distal end in a stop 20 which projects radially outward relative to bearing member wall 10 to prevent passage of a roller outer end 2A past the bearing member. The bearing member is formed from a suitable plastic to enable arm 15 to be of a flexible nature, allowing arm and stop displacement by the application of fingertip exerted force, as shown in FIG. 3. Accordingly, removal of roller 2 may be achieved by momentary fingertip displacement of stop 20 to permit the advancement of roller end 2A slightly therepast, whereafter the stop slides along the inner wall of the roller. Conversely, for installation of a new roller, fingertip pressure is applied directly to arm 15 to displace the arm and specifically stop 20 into channel 16, whereupon the inner end of the roller may be slid over the stop which remains retracted in channel 16 by the roller until passage of outer end 2A of the roller therepast.

Regardless of variances in the inner diameter between rollers, occurring during manufacture or from use, roller 2 will be confined against outward displacement as stop 20 will be abutted by the roller core. The outer cap barrier provided by walls 17, 18 will at all times prevent entry of paint into the roller interior while lending itself to convenient cleaning at the end of a painting operation.

While I have shown but one embodiment of the invention, it will be apparent to those skilled in the art that the invention may be embodied still otherwise without departing from the spirit and scope of the invention.

Having thus described the invention, what is desired to be secured by a Letters Patent is:

I claim:

1. A frame for supporting a replaceable paint roller, comprising a handle attached to a rod having first and second bearings thereon for receiving and supporting the paint roller, the first bearing being located proximate a terminal end of the rod, the first bearing having an annular wall and an end wall substantially abutting an outer end of the annular wall, and a retainer connected to one of the walls of the first bearing, the retainer including a manually actuated stop such that when the stop is in its normal unactuated condition the stop inhibits axially outward movement of a paint roller mounted on the bearings and such that when the stop is manually actuated a paint roller can be inserted axially onto the bearings or removed axially therefrom while the end wall is coupled to the annular wall.

2. The frame of claim 1 wherein the stop is located proximate the end wall.

3. The frame of claim 1 wherein the end wall is substantially planar and the stop includes a distal surface and a proximal surface and the proximal surface is substantially coplanar with the end wall.

4. The frame of claim 1 wherein the end wall is substantially planar and the stop includes a distal surface and a proximal surface and the distal surface is substantially coplanar with the end wall.

5. The frame of claim 1 wherein the end wall is non-concave.

6. The frame of claim 1 further comprising a wire cage having a plurality of wire spokes that are supported by, and extend between the first and second bearings and wherein the wire cage assists to support the paint roller.

7. The frame of claim 1 wherein the retainer comprises an arm resiliently coupled to the annular wall and extending toward the end wall, the arm terminating at the stop.

8. The frame of claim 1 wherein the retainer comprises an elongate arm resiliently coupled to the annular wall, the arm terminating at the stop, wherein the stop is upturned from the arm and substantially orthogonal to the arm.

9. The frame of claim 1 wherein the wall and the end wall define a recess and the retainer is located substantially within the recess.

10. The frame of claim 1 wherein the annular wall and the end wall define a recess having tapered side walls and a bottom wall and the retainer is located in the recess between the side walls.

11. The frame of claim 1 wherein the annular wall defines an elongate recess having a triangular longitudinal cross section and a U-shaped transverse cross section and the retainer is located within the recess.

12. The frame of claim 1 wherein the annular wall and end wall define a recess comprising a bottom wall that intersects the annular wall and the end wall, the bottom wall being bounded by side walls so that the end wall, bottom wall, and side walls form a liquid barrier to block a liquid when a paint roller is mounted onto the frame thereby defining an interior chamber wherein it is desirable to prevent liquid from entering the chamber.

13. The frame of claim 1 further comprising a wire cage having a plurality of wire spokes that are supported by the first and second bearings and wherein the first bearing includes receptacles for receiving spokes of the wire cage and the annular wall defines a recess that is located between the receptacles and the retainer is located in the recess.

14. A frame for a paint roller, the frame including a handle coupled to a rod, first and second bearings located on the rod, the first and second bearings located in spaced apart relationship to support a paint roller, characterized by the first bearing having an annular side wall having a width, an end wall fixedly coupled to the side wall, a retainer for retaining a paint roller on the frame during operation of the paint roller, the retainer including an arm that is resiliently coupled to the side wall and including a stop coupled to the arm and located proximate the end wall.

15. The frame of claim 14 wherein the end wall is substantially planar and the stop includes a surface that is substantially coplanar with the end wall.

16. The frame of claim 14 wherein the retainer arm is substantially coplanar with the annular side wall.

17. The frame of claim 14 wherein the arm has a length that is less than the width of the side wall.

18. The frame of claim 14 wherein the retainer deflects during installation and deinstallation of a paint roller onto the frame and when the paint roller is installed onto the frame the retainer is biased into a position substantially flush with the annular side wall and thereby retains the paint roller on the frame.

19. The frame of claim 14 wherein the side wall and the end wall define a recess for receiving the retaining when the retainer is deflected during installation and deinstallation of a paint roller onto the frame.

20. The frame of claim 14 wherein the side wall and the end wall define a recess for receiving the retainer when the retainer is deflected, wherein the recess includes a bottom wall that extends obliquely between the side wall and the end wall and tapered sides that extend between the bottom wall and the side wall thereby forming a wedge shaped recess and the retainer is located substantially within the recess.

21. The frame of claim 14 wherein the side wall and the end wall define a recess having a bottom wall that extends obliquely between the side wall and the end wall thereby forming a junction at the bottom wall and the side wall and wherein the retainer arm is coupled to the side wall proximate the junction.

22. The frame of claim 14 wherein the side wall and the end wall define a recess having boundary surfaces, and the side wall, end wall and recess surfaces create a barrier to block liquid so that when a paint roller is installed onto the frame, thereby creating a chamber bounded by the paint roller and the first and second bearings, the barrier blocks liquid from entering the chamber.

23. The frame of claim 14 wherein the side wall and end wall are coupled at a substantially circular edge and the side wall and end wall define a recess having a bottom wall that extends between, and obliquely intersects, the side wall and end wall, the bottom wall intersecting the end wall at a first distance from the edge, wherein the retainer is located in the recess and resiliently coupled to the side wall proximate the intersection of the side wall and the bottom wall, and wherein the retainer stop has a height that is substantially equal to the first distance.

* * * * *